US008879958B2

(12) United States Patent
Birumachi

(10) Patent No.: US 8,879,958 B2
(45) Date of Patent: Nov. 4, 2014

(54) IMAGE FORMING APPARATUS

(75) Inventor: Takashi Birumachi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 590 days.

(21) Appl. No.: 13/089,090

(22) Filed: Apr. 18, 2011

(65) Prior Publication Data

US 2011/0268475 A1 Nov. 3, 2011

(30) Foreign Application Priority Data

Apr. 28, 2010 (JP) ..... 2010-104302

(51) Int. Cl.
*G03G 15/00* (2006.01)
*G03G 15/01* (2006.01)

(52) U.S. Cl.
CPC .... *G03G 15/0178* (2013.01); *G03G 2221/1657* (2013.01); *G03G 2215/0158* (2013.01); *G03G 15/757* (2013.01)
USPC ..... 399/167

(58) Field of Classification Search
USPC ..... 399/167
See application file for complete search history.

(56) References Cited

U.S. PATENT DOCUMENTS

| | | | | |
|---|---|---|---|---|
| 2002/0012549 | A1* | 1/2002 | Oku | 399/167 |
| 2003/0152402 | A1* | 8/2003 | Ehara et al. | 399/167 |
| 2005/0238372 | A1 | 10/2005 | Shinohara et al. | |
| 2007/0242980 | A1 | 10/2007 | Kikuchi et al. | |
| 2009/0285601 | A1 | 11/2009 | Akamatsu | |
| 2009/0311007 | A1* | 12/2009 | Mochizuki et al. | 399/167 |

FOREIGN PATENT DOCUMENTS

| | | | |
|---|---|---|---|
| JP | 2000-197332 | A | 7/2000 |
| JP | 2005-094987 | A | 4/2004 |
| JP | 2004-350386 | A | 12/2004 |
| JP | 2007-047629 | A | 2/2007 |
| JP | 2008-257203 | A | 10/2008 |
| JP | 2009-258424 | A | 11/2009 |
| JP | 2010-019930 | A | 1/2010 |

* cited by examiner

*Primary Examiner* — Ryan Walsh
(74) *Attorney, Agent, or Firm* — Canon USA Inc IP Division

(57) ABSTRACT

An image forming apparatus includes a first image forming means for forming a toner image on a first photosensitive drum, a first motor configured to rotationally drive the first photosensitive drum, a second image forming means for forming a toner image on a second photosensitive drum having an outer diameter larger than that of the first photosensitive drum, and a second motor configured to rotationally drive the second photosensitive drum. The first motor is a DC motor, and the second motor is a stepping motor.

11 Claims, 7 Drawing Sheets

ONE-STAGE SPEED REDUCTION

TWO-STAGE SPEED REDUCTION

IMAGE FORMING APPARATUS

BACKGROUND OF THE INVENTION

1. Field of the Invention

The present invention relates to an image forming apparatus that includes a first photosensitive drum, and a second photosensitive drum larger in outer diameter than the first photosensitive drum.

2. Description of the Related Art

As an electrophotographic color image forming apparatus, there is a tandem color image forming apparatus that includes yellow, magenta, cyan, and black photosensitive drums. Concerning such a color image forming apparatus, to suppress positional deviation between color images, there has been a proposal to drive a plurality of photosensitive drums respectively by different motors instead of a single motor (refer to Japanese Patent Application Laid-Open No. 2007-047629). The plurality of photosensitive drums are respectively driven by the different motors, and the motors are individually controlled according to rotational speeds of the photosensitive drums. As a result, a difference in rotational phase among the photosensitive drums can be reduced, positional deviation between the color images can be suppressed, and image quality can be improved.

To lower a replacement frequency of a black photosensitive drum by extending a life of the black photosensitive drum which is frequently used, there has been a proposal to make an outer diameter of the black photosensitive drum larger than that of the color photosensitive drum (refer to Japanese Patent Application Laid-Open No. 2007-047629). By making the outer diameter of the black photosensitive drum larger, the circumference of the photosensitive drum is longer, so a deterioration level of the photosensitive drum is smaller when an image is formed on a recording sheet, and the photosensitive drum has a longer life.

Even when the outer diameter of the black photosensitive drum is made larger than that of the color photosensitive drum, a circumferential speed of the black photosensitive drum must be matched with that of the color photosensitive drum. This is because, in order to transfer a toner image formed on each photosensitive drum onto an intermediate transfer belt in contact with each photosensitive drum, a circumferential speed of each photosensitive drum must be matched with that of the intermediate transfer belt. An angular speed of the black photosensitive drum is accordingly lower than that of the color photosensitive drum. Driving torque of the black photosensitive drum is higher than that of the color photosensitive drum.

Normally, when the plurality of photosensitive drums are driven by the different motors, it is sufficient if each driving control is independent, and thus any types of motors can be used. For example, a direct-current (DC) brushless motor maybe used for driving all the photosensitive drums. However, in the case of the DC brushless motor, an angle between magnetic poles is not small, and hence rotation unevenness disadvantageously occurs in a low-speed area (of operation). Thus when the black photosensitive drum of the large outer diameter is driven by the DC brushless motor, rotation unevenness may cause reduction of image quality.

In contrast, a stepping (stepper) motor may be used for driving all the photosensitive drums. However, the stepping motor shows a torque shortage in a high-speed area (of operation), and has a disadvantage of vibrations caused by step-driving. Thus when the color photosensitive drum of a small outer diameter is driven by the stepping motor, countermeasures must be taken against a torque shortage and vibrations.

SUMMARY OF THE INVENTION

According to an aspect of the present invention, an image forming apparatus includes a first image forming unit configured to forma toner image on a first photosensitive drum of the first outer diameter, a first motor configured to rotationally drive the first photosensitive drum, a second image forming unit configured to form a toner image on a second photosensitive drum of the second outer diameter larger than the first outer diameter, and a second motor configured to rotationally drive the second photosensitive drum, wherein the first motor is a DC motor, and the second motor is a stepper motor.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
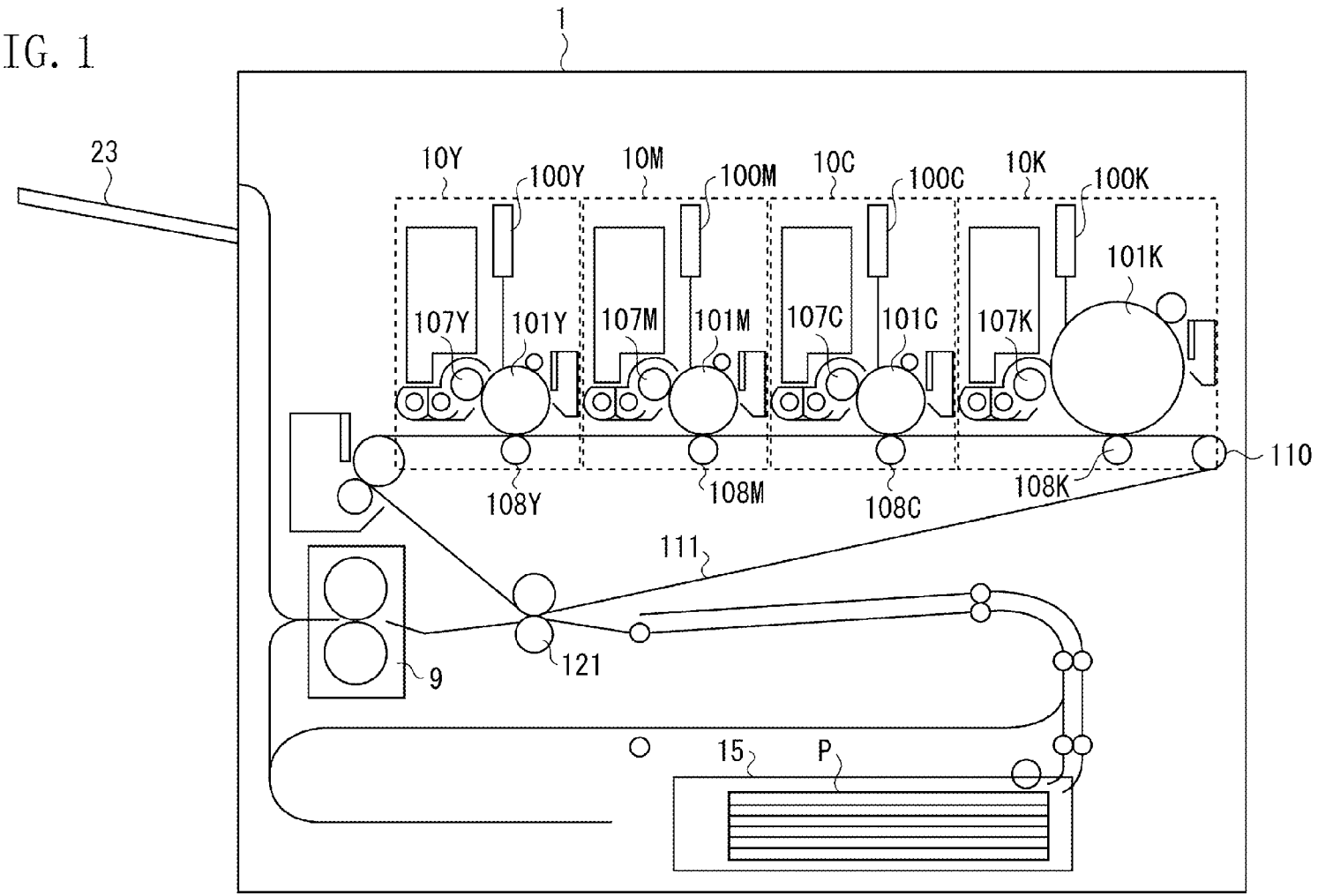
FIG. 1 is a sectional view illustrating an image forming apparatus according to an exemplary embodiment of the present invention.

FIG. 1 is a sectional view illustrating a color image forming apparatus of a tandem intermediate transfer type according to an exemplary embodiment of the present invention. The image forming apparatus 1 includes image forming stations 10Y, 10M, 10C, and 10K for yellow, magenta, cyan, and black. The image forming stations 10Y, 10M, 10C, and 10K respectively form images of yellow (Y), magenta (M), cyan (C), and black (K). The image forming stations 10Y, 10M, 10C, and 10K respectively include a photosensitive drum 101Y for forming a yellow image, a photosensitive drum 101M for forming a magenta image, a photosensitive drum 101C for forming a cyan image, and a photosensitive drum 101K for forming a black image. The photosensitive drums 101Y, 101M, and 101C constitute first photosensitive drums, and the photosensitive drum 101K constitutes a second photosensitive drum.

The image forming stations 10Y, 10M, 10C, and 10K respectively include exposure devices 100Y, 100M, 100C, and 100K, development devices 107Y, 107M, 107C, and 107K, and primary transfer devices 108Y, 108M, 108C, and 108K. The exposure devices 100Y, 100M, 100C, and 100K of the image forming stations form latent images on the photosensitive drums 101Y, 101M, 101C, and 101K according to image data. The development devices 107Y, 107M, 107C, and 107K respectively develop the latent images on the photosensitive drums 101Y, 101M, 101C, and 101K by yellow toner, magenta toner, cyan toner, and black toner. The primary transfer devices 108Y, 108M, 108C, and 108K transfer toner images on the photosensitive drums 101Y, 101M, 101C, and 101K onto an intermediate transfer belt 111. The images of Y, M, C, and K are accordingly superimposed on the intermediate transfer belt 111. A recording sheet P stored in a recording sheet cassette 15 is conveyed to a secondary transfer roller 121. The toner images born on the intermediate transfer belt 111 are secondary-transferred to the recording sheet P by the secondary transfer roller 121. The toner images on the recording sheet P are fixed and pressured by a fixing device 9 to be a fixed image. The recording sheet P passed through the fixing device 9 is discharged to a sheet discharge tray 23.

Figure 2:
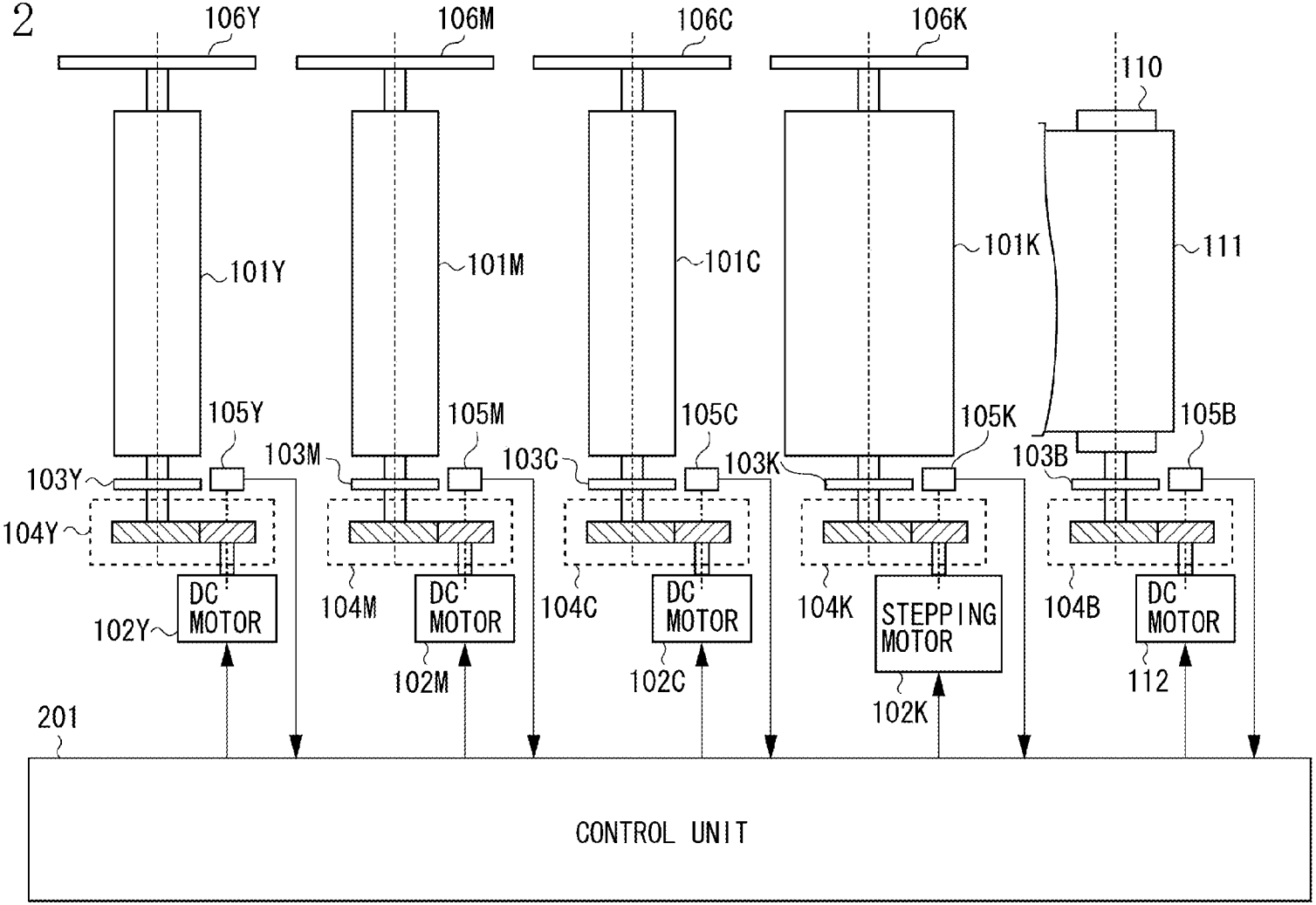
FIG. 2 illustrates a driving configuration of photosensitive drums and an intermediate transfer belt.

FIG. 2 illustrates a driving configuration of the photosensitive drums 101Y, 101M, 101C, and 101K and the intermediate transfer belt 111. The photosensitive drums 101Y, 101M, 101C, and 101K, and the intermediate transfer belt 111 are rotationally driven by different driving motors. Driving motors 102Y, 102M, 102C, and 102K rotationally drive the photosensitive drums 101Y, 101M, 101C, and 101K respectively via speed reducers 104Y, 104M, 104C, 104K, and 104B. A driving motor 112 rotationally drives a driving roller 110 for driving the intermediate transfer belt 111. A speed reducer 104 includes a combination of gears, preferably helical gears. Drive shafts of the photosensitive drums 101Y, 101M, 101C, and 101K and the driving roller 110 include encoder wheels 103Y, 103M, 103C, and 103K and 103B for detecting angular speeds thereof. Encoder sensors 105Y, 105M, 105C, 105K, and 105B detect the angular speeds by optically detecting slits arranged at equal intervals in a circumferential direction of the encoder wheels 103Y, 103M, 103C, 103K, and 103B. Flywheels 106Y, 106M, 106C, and 106K for suppressing rotational speed fluctuations are connected to the photosensitive drums 101Y, 101M, 101C, and 101K via the drive shafts. Rotational speeds of the driving motors 102Y, 102M, 102C, and 102K are controlled by a control unit 201 according to detection results of the encoder sensors 105Y, 105M, 105C, and 105K. A rotational speed of the driving motor 112 is controlled by the control unit 201 according to a detection result of the encoder sensor 105B. To detect the rotational speeds of the driving motors, a tacho generator or a resolver can be used.

An outer diameter of each photosensitive drum 101 is described. An outer diameter of the photosensitive drum 101K for forming a black image (black photosensitive drum) is set larger than those of the color image forming photosensitive drums (color photosensitive drums) 101Y, 101M, and 101C. A reason is as follows. Generally, a monochrome (black and white) image is formed more frequently than a color image. Conventionally, when an outer diameter of the black photosensitive drum is equal to those of the color photosensitive drums, the black photosensitive drums is deteriorates relatively more rapidly than the color photosensitive drums, and hence the black photosensitive drum must be replaced more frequently than the color photosensitive drums. Thus, the outer diameter of the black photosensitive drum is set larger than those of the color photosensitive drums. If the outer diameter of the black photosensitive drum is made larger, the circumference of the photosensitive drum is longer (larger), so a deterioration level of the photosensitive drum is lower when an image is formed on one recording sheet, and the photosensitive drum has a longer life. As a result, a replacement frequency of the larger black photosensitive drum can be lower than the smaller conventional drum.

Figure 3A:
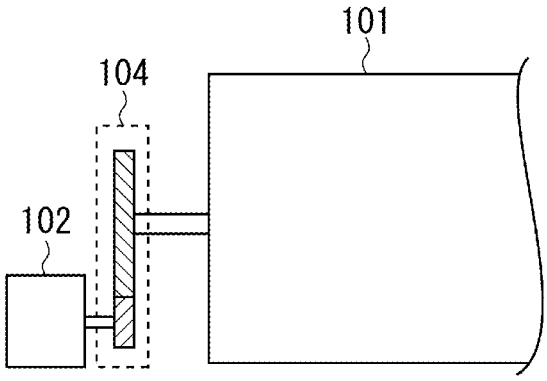
FIGS. 3A and 3B illustrate speed reducer of one-stage speed reduction and two-stage speed reduction.
Figure 3B:
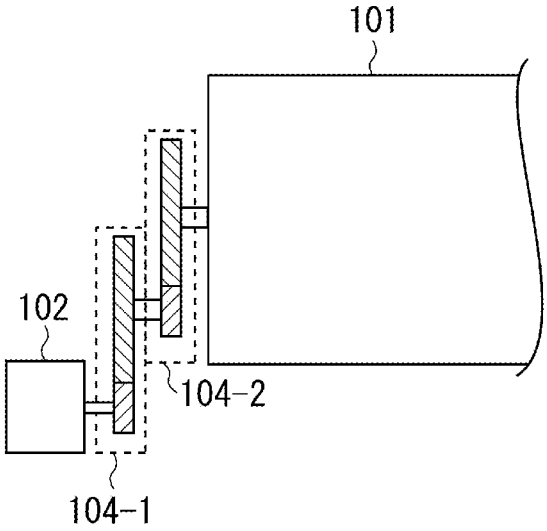

Concerning the speed reducer 104, preferably speed reducers of identical one-stage speed reduction models (equal speed reduction ratios) are used for all the speed reducer 104K of the black photosensitive drum, the speed reducers 104Y, 104M, and 104C of the color photosensitive drums, and the speed reducer 104B of the intermediate transfer belt. A reason is as follows. FIGS. 3A and 3B illustrate speed reducers of one-stage speed reduction and two-stage speed reduction: FIG. 3A illustrates the speed reducer of one-stage speed reduction, and FIG. 3B illustrates the speed reducer of two-stage speed reduction. In a configuration of the one-stage speed reduction, as illustrated in FIG. 3A, the driving motor 102 rotationally drives the photosensitive drum 101 via the speed reducer 104. In a configuration of the two-stage speed reduction, as illustrated in FIG. 3B, the driving motor 102 rotationally drives the photosensitive drum 101 via a first-stage speed reducer 104-1 and a second-stage speed reducer 104-2. The driving motor 102 illustrated in FIG. 3B has an advantage of being able to drive the photosensitive drum 101 by driving torque lower than that for the driving motor 102 illustrated in FIG. 3A. However, there is a disadvantage in that an amount of positional deviation with respect to a rotational angle after two-stage speed reduction in the configuration illustrated in FIG. 3B becomes larger than a rotational angle after one-stage speed reduction in the configuration illustrated in FIG. 3A.

Figure 4A:
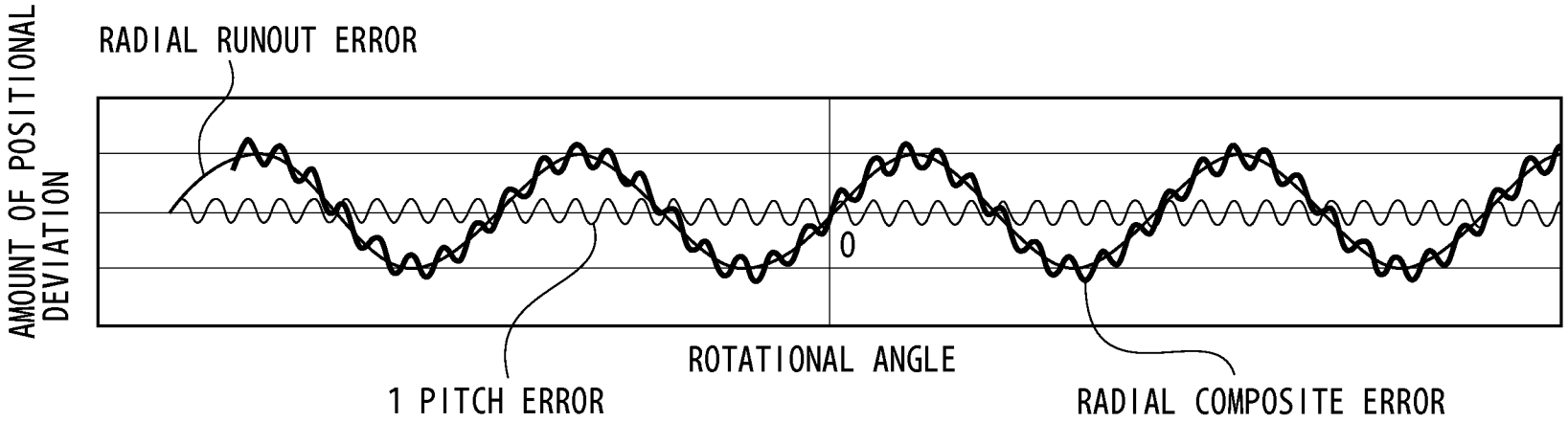
FIGS. 4A and 4B illustrate amounts of positional deviation in one-stage speed reduction and two-stage speed reduction.
Figure 4B:
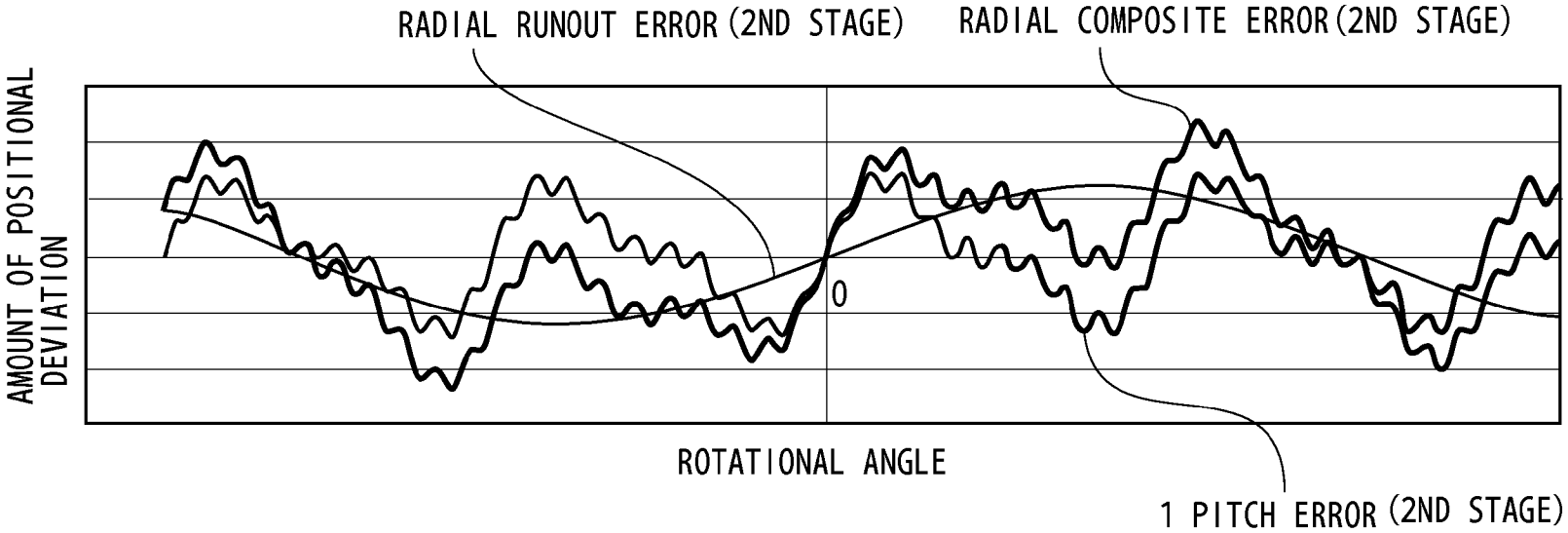

FIGS. 4A and 4B illustrate amounts of positional deviation in one-stage speed reduction and two-stage speed reduction: FIG. 4A illustrates an amount of positional deviation with respect to a rotational angle after one-stage speed reduction, and FIG. 4B illustrates an amount of positional deviation with respect to a rotational angle after two-stage speed reduction. In the case of the one-stage speed reduction, as illustrated in FIG. 4A, a radial composite error to which a tooth groove vibration error and a pitch error of the speed reducer are added, appears as an amount of positional deviation. In the case of the two-stage speed reduction, as illustrated in FIG. 4B, a radial composite error to which a tooth groove vibration error and a pitch error of the second-stage speed reduction are added, appears as an amount of positional deviation in the radial composite error of the one-stage speed reduction. The amount of positional deviation is larger in the two-stage speed reduction than that in the one-stage speed reduction. In the present exemplary embodiment, therefore, the same speed reducer of one-stage speed reduction as that of the color photosensitive drum is used for the speed reducer 104K of the black photosensitive drum 104K having the outer diameter larger than those of the color photosensitive drums. The photosensitive drum can be driven without using any speed reducer. However, a driving motor having driving torque necessary for driving the photosensitive drum is expensive, and hence a speed reducer of one-stage speed reduction is preferably used. The speed reducer of the identical models are preferably used for all the speed reducers of the black photosensitive drum, the color photosensitive drums, and the intermediate transfer belt, because the use of many speed reducers of identical models enables reduction of costs. Helical gears are preferably also used for the speed reducers.

Next, a type of each driving motor is described. The black photosensitive drum 101K and the color photosensitive drums 101Y, 101M, and 101C rotate in contact with the intermediate transfer belt 111. Circumferential speeds of the black photosensitive drum, the color photosensitive drums, and the intermediate transfer belt must accordingly be equal to one another. As described above, the outer diameter of the black photosensitive drum 101K is larger than those of the color photosensitive drums 101Y, 101M, and 101C. Thus, the black photosensitive drum must stably rotate at a rotational speed (angular speed) which is lower than those for the color photosensitive drums. The speed reducer 104K of one-stage speed reduction identical to those of the color photosensitive drums 101Y, 101M, and 101C (equal speed reduction ratios) is used for the speed reducer of the black photosensitive drum 101K. A cleaner (not shown) is in contact with surfaces of all of the black photosensitive drum 101K and the color photosensitive drums 101Y, 101M, and 101C, and substantially equal loads are applied on the surfaces of all the photosensitive drums. Thus, driving torque of the black photosensitive drum is larger than those of the color photosensitive drums. In the present exemplary embodiment, therefore, outer-rotor (external-rotor) type DC brushless motors are used as driving motors for the color photosensitive drums 101Y, 101M, and 101C, and the intermediate transfer belt 111, and a hybrid (inner-rotor) type stepping (stepper) motor is used as a driving motor for the black photosensitive drum 101K.

A reason is as follows. When the color photosensitive drums have outer diameters of 30 millimeters, and the black photosensitive drum has an outer diameter of 84 millimeters, to match circumferential speeds of the color photosensitive drums and the black photosensitive drum, a rotational speed of the black photosensitive drum must be set to 645 rpm, assuming that rotational speeds of the color photosensitive drums are 1806 rpm per unit time. The outer-rotor type DC brushless motor has an advantage of being able to stably rotate in a high-speed area. However, there is a disadvantage in that stable rotation is difficult in a low-speed area. It is because an angle between magnetic poles of the DC brushless motor is generally 15 to 30 degrees, and hence rotation unevenness appears in the low-speed area when the DC brushless motor is driven by a rectangular wave. The hybrid inner-rotor type stepping motor has an advantage of being able to realize stable rotation at high torque in a low-speed area since one step angle thereof is generally 0.9 to 3.6 degrees. However, there are disadvantages in that torque drops in a high-speed area and in that power efficiency is ½ to ⅓ of that of the DC brushless motor.

Thus, in the exemplary embodiment, the outer-rotor type DC brushless motors are used as the driving motors for the color photosensitive drums 101Y, 101M, and 101C and the intermediate transfer belt 111, and the hybrid (inner-rotor) type stepping motor is used as the driving motor for the black photosensitive drum 101K. Vibrations caused by step-driving unique to the stepping motor are reduced by low-pass filter effects provided by moment of inertia of the black photosensitive drum 101K having the large outer diameter and the flywheel 106K. Thus, the disadvantages of the stepping motor can be suppressed, and the advantages can be effectively utilized. When the DC brushless motors for driving the small-diameter color photosensitive drums and the hybrid stepping motor for driving the large-diameter black photosensitive drum are used, stable rotation of the color photosensitive drums and the black photosensitive drum can be performed. As a result, higher image quality can be achieved for image formation, and power efficiency can be improved.

An angle between magnetic poles of the DC brush motor is generally 30 to 45 degrees, and an angle between magnetic poles of a DC motor including a DC brushless motor and a DC brush motor is generally 15 to 45 degrees. One step angle of a phase-modulation (PM) stepping motor is generally 7.5 to 15 degrees. Thus, one step angle of a stepping motor including a hybrid stepping motor and a PM stepping motor is generally 0.9 to 15 degrees. As can be understood, whether it be a DC brushless motor or a DC brush motor, the DC motor has an advantage of stable rotation in the high-speed area, and a disadvantage of difficulty in stable rotation in the low-speed area. The stepping motor has an advantage of stable rotation at high torque in the low-speed area, and a disadvantage of a drop of torque in the high speed area. Thus, if the DC motors is used for driving the small-diameter color photosensitive drums, and the stepping motor is used for driving the large-diameter black photosensitive drum, stable rotation of the color photosensitive drums and the black photosensitive drum can be achieved. As a result, higher image quality can be achieved for image formation, and power efficiency can be improved. From the viewpoint of rotational stability, the outer-rotor DC motor can be used for the DC motor, and the inner-rotor stepping motor is generally used for the stepping motor.

Figure 5:
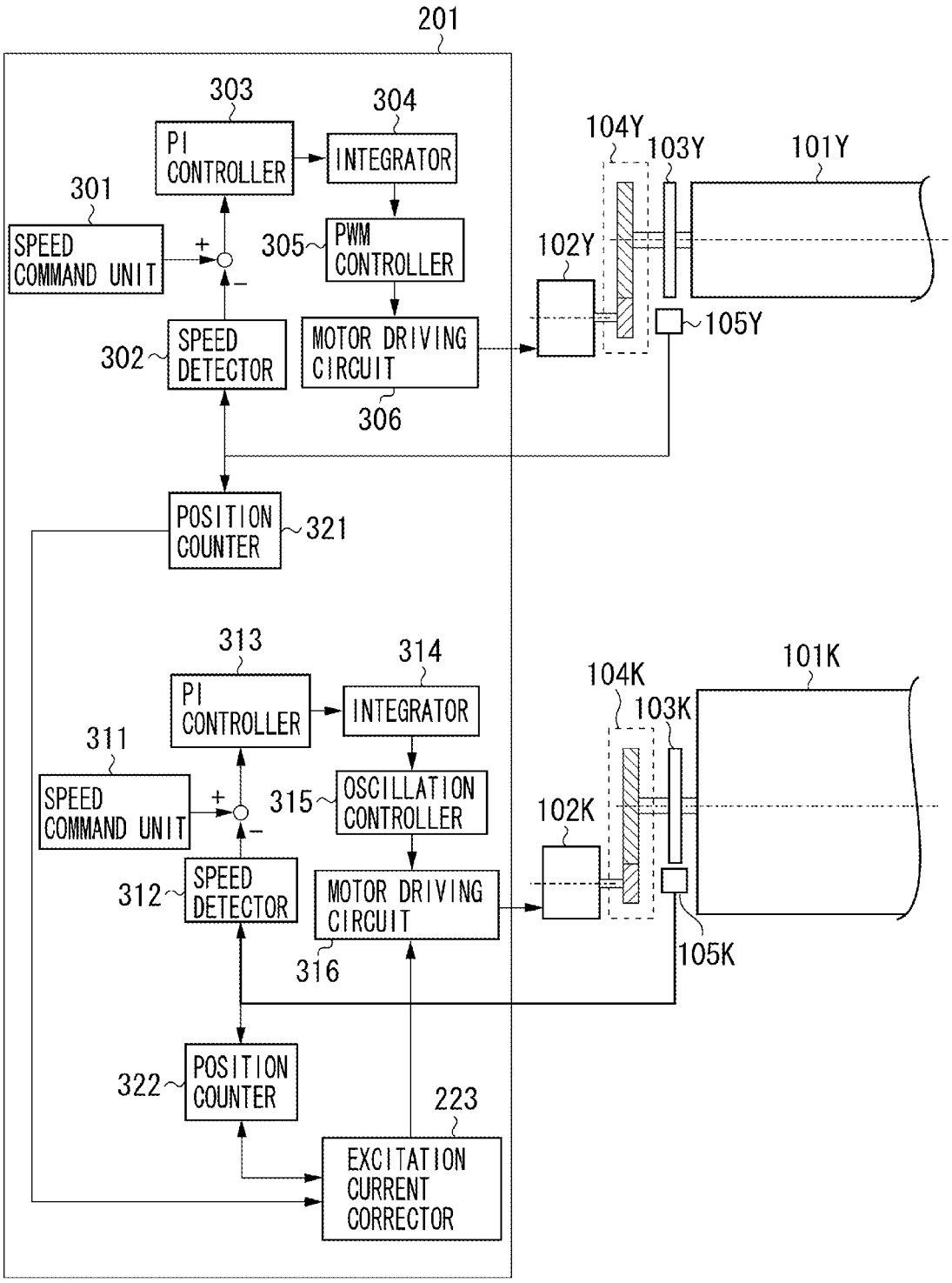
FIG. 5 is a control block diagram of each driving motor.

FIG. 5 is a control block diagram of each driving motor. FIG. 5 is a control block diagram illustrating the driving motor (DC brushless motor) 102Y for driving the color photosensitive drum 101Y and the driving motor (hybrid stepping motor) 102K for driving the black photosensitive drum 101K.

Speed control of the DC brushless motor is performed by pulse width modulation control (PWM control) for controlling an ON-OFF ratio (duty ratio) of a switching element disposed between a DC power source and the motor. The encoder sensor 105Y outputs a pulse signal to a speed detector 302 each time a slit of the encoder wheel 103Y disposed in the drive shaft of the photosensitive drum 101Y is detected. The speed detector 302 detects a rotational speed of the photosensitive drum 101Y based on the number of pulse signals output from the encoder sensor 105Y within a predetermined period of time. An error of a detected speed output from the speed detector 302 with respect to an instructed speed output from a speed command unit 301 is input to a proportional-integral (PI) controller 303. The PI controller 303 amplifies the input error based on preset proportional and integral gains. An integrator 304 integrates the error amplified by the PI controller 303 to acquire position deviation. A PWM controller 305 generates a PWM signal based on an output from the integrator 304. A motor driving circuit 306 supplies a voltage based on the PWM signal from the PWM controller 305 to the DC brushless motor 102Y. This way, a rotational speed and a rotational phase of the DC brushless motor 102Y are controlled.

Speed control of the hybrid stepping motor is performed based on a frequency of a command pulse. The encoder sensor 105Y outputs a pulse signal to a speed detector 312 each time a slit of the encoder wheel 103K disposed in the drive shaft of the photosensitive drum 101K is detected. The speed detector 312 detects a rotational speed of the photosensitive drum 101K based on the number of pulse signals output from the encoder sensor 105K within a predetermined period of time. An error of a detected speed output from the speed detector 312 with respect to an instructed speed output from a speed command unit 311 is input to a PI controller 313. The PI controller 313 amplifies the input error based on preset proportional and integral gains. An integrator 314 integrates the error amplified by the PI controller 313 to acquire position deviation. An oscillation controller 315 generates a pulse signal of a frequency based on an output from the integrator 314. A motor driving circuit 316 controls turning ON or OFF of a current supplied to an excitation layer of the hybrid stepping motor 102K based on the pulse signal from the oscillation controller 315. This way, a rotational speed and a rotational phase of the hybrid stepping motor 102K are controlled.

A position counter 321 detects a rotational position (rotational phase) of the photosensitive drum 101Y by counting the number of pulse signals output from the encoder sensor 105Y. A position counter 322 detects a rotational position (rotational phase) of the photosensitive drum 101K by counting the number of pulse signals output from the encoder sensor 105K. An excitation current correction unit 323 determines a lagging amount of the rotational phase detected by the position counter 322 with respect to the rotational phase detected by the position counter 321, and supplies an excitation current proportional to the lagging amount of the rotational phase from the motor driving circuit 316 to the stepping motor 102K. When a large load is applied on a driving target of the stepping motor, a rotational phase of the stepping motor lags behind an excitation phase of a stator. However, the lagging of the rotational phase can be suppressed by supplying an excitation current proportional to the lagging of the rotational phase to the stepping motor. In the present exemplary embodiment, the excitation current to the stepping motor 102K is increased in proportion to the lagging of the rotational phase of the photosensitive drum 101K with respect to the photosensitive drum 101Y. Thus, deviation in rotational phase between the photosensitive drum 101Y and the photosensitive drum 101K can be suppressed.

Figure 6:
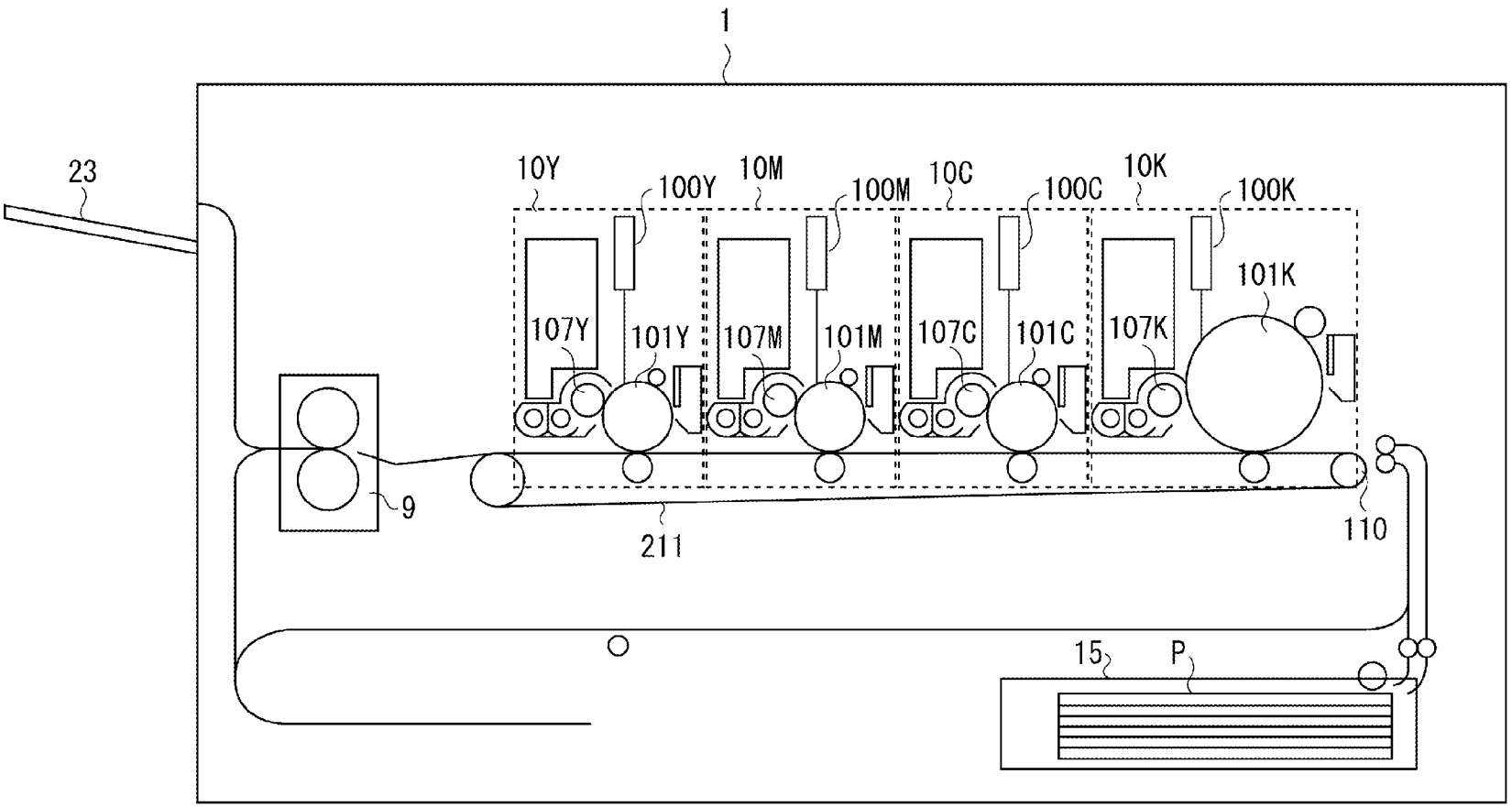
FIG. 6 is a sectional view illustrating an image forming apparatus according to another exemplary embodiment of the present invention.

The exemplary embodiment of the present invention has been directed to the color image forming apparatus of the tandem intermediate transfer type. However, as illustrated in FIG. 6, the invention can also be applied to a color image forming apparatus of a tandem direct transfer type. In this case, a configuration is similar to that of the exemplary embodiment except that a conveyor belt 211 conveys a recording sheet P, and a toner image on a photosensitive drum 101 is transferred to the recording sheet P on the conveyor belt 211 by a transfer device of each image forming station 10. The conveyor belt 211 is driven by a driving roller 110, and the driving roller 110 is driven by a DC motor, preferably a DC brushless motor.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-104302 filed Apr. 28, 2010, which is hereby incorporated by reference herein in its entirety.

What is claimed is:

1. An image forming apparatus comprising:

a first image forming unit configured to form a toner image on a first photosensitive drum of a first outer diameter;

a first motor configured to rotate the first photosensitive drum;

a second image forming unit configured to form a toner image on a second photosensitive drum of the second outer diameter larger than the first outer diameter; and a second motor configured to rotate the second photosensitive drum, wherein the first motor is a DC motor, and the second motor is a stepper motor;

an excitation current correction unit configured to increase or decrease an excitation current supplied to the stepper motor according to a lag or a lead of a rotational phase of the second photosensitive drum of the second outer diameter with respect to the first photosensitive drum of the first outer diameter.

2. The image forming apparatus according to claim 1, wherein the first image forming unit forms a color toner image on the first photosensitive drum , and the second image forming unit forms a black toner image on the second photosensitive drum.

3. The image forming apparatus according to claim 2, wherein the first image forming unit forms a cyan toner image on the first photosensitive drum of the first outer diameter;

further comprising:

a third image forming unit configured to form a magenta toner image on a third photosensitive drum of the first outer diameter; and a fourth image forming unit configured to form a yellow toner image on a fourth photosensitive drum of the first outer diameter.

4. The image forming apparatus according to claim 3, further comprising:

a third motor configured to rotate the third photosensitive drum; and a fourth motor configured to rotate the fourth photosensitive drum, wherein the third and fourth motors are DC motors.

5. The image forming apparatus according to claim 1, further comprising:

an intermediate transfer belt configured to receive the toner images formed on the first and second photosensitive drums and to transfer the toner images to a recording sheet; and a driving roller configured to rotate the intermediate transfer belt, wherein the driving roller is driven by a DC motor .

6. The image forming apparatus according to claim 1, wherein the DC motor is a DC brushless motor and the stepper motor is a hybrid stepper motor.

7. The image forming apparatus according to claim 1, wherein the DC motor is an outer-rotor type DC motor and the stepper motor is an inner-rotor type stepper motor.

8. An image forming apparatus comprising;

a first image forming unit configured to form a toner image on a first photosensitive drum of a first outer diameter;

a first motor, the first motor being a DC motor;

a first speed reducer between the DC motor and the first photosensitive drum of the first outer diameter, wherein the first motor rotates the first photosensitive drum of the first diameter via the first speed reducer;

a second image forming unit configured to form a toner image on a second photosensitive drum of a second outer diameter larger than the first outer diameter; and a second motor configured to rotate the second photosensitive drum, the second motor being a stepper motor; and a second speed reducer between the stepper motor and the second photosensitive drum of the second outer diameter, wherein the second motor rotates the second photosensitive drum of the second outer diameter via the second speed reducer.

9. The image forming apparatus according to claim 8, wherein the first and second speed reducers are one-stage speed reducers.

10. The image forming apparatus according to claim 8, wherein the first and second speed reducers have the same speed reduction ratio.

11. The image forming apparatus according to claims 8, wherein the first and second speed reducers are speed reducers of identical parts.

* * * * *